US006189886B1

(12) United States Patent
Moran

(10) Patent No.: US 6,189,886 B1
(45) Date of Patent: Feb. 20, 2001

(54) BOARD GAME BASED ON STOCK MARKET CONCEPTS

(76) Inventor: Gayle Marie Moran, 2347 Ashley Park Blvd., Plano, TX (US) 75074

( * ) Notice: Under 35 U.S.C. 154(b), the term of this patent shall be extended for 0 days.

(21) Appl. No.: 09/370,610

(22) Filed: Aug. 7, 1999

(51) Int. Cl.[7] ..... A63F 3/00

(52) U.S. Cl. ..... 273/256; 273/256; 273/243; 273/278

(58) Field of Search ..... 273/256, 242, 273/236, 240, 244.2, 243, 278

(56) References Cited

U.S. PATENT DOCUMENTS 3,740,037 * 6/1973 De Bono .
3,765,682 * 10/1973 Braude .
3,980,307 9/1976 Raub .
4,002,342 1/1977 Biggs .
4,014,554 * 3/1977 Krummacher .
4,363,489 12/1982 Chodak .
4,431,195 2/1984 Brand et al. .
4,896,888 * 1/1990 Owen .
4,934,707 6/1990 Koster .
5,139,269 * 8/1992 Peterson .
5,273,431 * 12/1993 Charouhas .
5,451,061 * 9/1995 DeLessio .
5,829,747 * 11/1998 Nebel .

* cited by examiner

*Primary Examiner*—Benjamin H. Layno
*Assistant Examiner*—V K Mendiratta

(57) ABSTRACT

A board game based on stock market concepts comprising a game board (10) having a path of varibly-colored spaces beginning at one top corner, winding up and down across the board, and ending at the opposite top corner. As players move around the board, they make choices and perform transactions relating to the space they have landed on: on colored spaces, they may buy or sell the specified color of stock; on white spaces (12), they may strategically jump to any other white space on the board; on gray news flash spaces (14), they draw a news flash card (22A–22B) and perform the expressed transaction; and when they land on or cross over the market update bar (16), they change the price-per-share cards (18A–18B). Players record their transactions and track their balances on a balance sheet (24). The game ends when one player reaches the agreed upon goal or when all players agree to end the game, in which case, a play-off round is performed.

10 Claims, 3 Drawing Sheets

BOARD GAME BASED ON STOCK MARKET CONCEPTS

BACKGROUND—FIELD OF INVENTION

This invention relates to board games; specifically to board games based on stock market concepts.

BACKGROUND—DESCRIPTION OF PRIOR ART

The stock market has changed rapidly and significantly over the past several years. Not only has it hit new highs, but it has become more easily accessible to more and more people. No longer the realm of the privileged few, the stock market has become something of a national pastime and a major investment vehicle for those with even average incomes.

The prior art shows that numerous inventors have created board games designed to simulate investing in the stock market: U.S. Pat. No. 3,980,307 to Raub (1976), U.S. Pat. No. 4,002,342 to Biggs (1977), U.S. Pat. No. 4,431,195 to Brand et al. (1984), U.S. Pat. No. 4,934,707 to Koster (1990), and U.S. Pat. No. 5,829,747 to Nebel (1998).

However, all of the stock market simulation board games heretofore known, contain a variety of inherent weaknesses, the most significant of which are complex designs (several require mechanical assemblage of the game board before play can begin) and complicated rules, conditions, and transactions. They tend to complicate play with overly sophisticated concepts such as labeling the market 'bull' or 'bear' (a concept that analysts recently said no longer applies to today's stock market), dealing with dividends and taxes, and varying stock prices based on demand. Obviously designed for sophisticated players who have extensive prior knowledge and a deep understanding of the stock market, these games are difficult to learn and difficult to play and they tend to get bogged down in numerous complicated transactions. They do not match the simplicity and speed of the game described in the current application, which is appropriate for family entertainment and as a teaching tool in an educational environment.

OBJECTS AND ADVANTAGES

Accordingly, several objects and advantages of the present invention are:

(a) to provide a board game based on stock market concepts that is simple in design;

(b) to provide a board game based on stock market concepts that is easy to learn and easy to play.

Further objects and advantages are:

(c) to provide a board game based on stock market concepts that is easy and inexpensive to manufacture;

(d) to provide a board game based on stock market concepts that reflects the power, excitement, and speed of today's stock market;

(e) to provide a board game based on stock market concepts that incorporates some flexibility to accommodate players' skills and preferences;

(f) to provide a board game based on stock market concepts that allows players to make strategic choices;

(g) to provide a board game based on stock market concepts that improves on the weaknesses and shortcomings of the prior art.

Further objects and advantages of my invention will become apparent from a consideration of the drawings and ensuing description.

DRAWING FIGURES

The file of this patent contains at least one drawing executed in color. Copies of this patent with color drawing (s) will be provided by the Patent and Trademark Office upon request and payment of the necessary fee.

FIG 4 shows a sample of news flash cards, which contain information in the form of an imaginary, fantastical, and/or humorous event and instructs the player who has drawn the card to buy or sell a specified stock at a price that is higher or lower than the current market price if the player is able to.

FIG. 6 shows a sample of a die.

LIST OF REFERENCE NUMERALS

Figure 1:
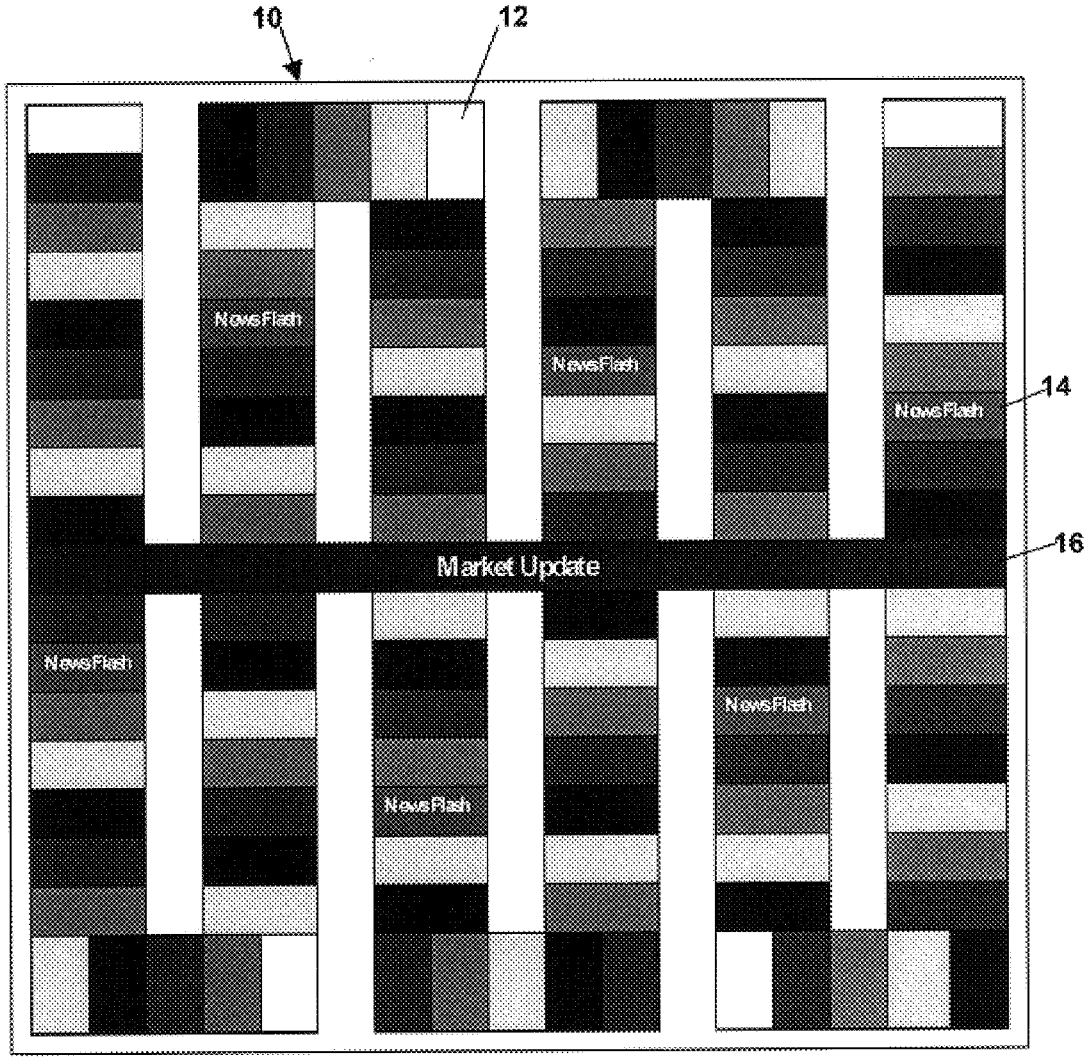
FIG. 1 shows a view of the playing board.

10 game board
12 white space on game board path
14 news flash space on game board path
16 market update spaces on game board path
18A price-per-share card, back
18B price-per-share card, front
20 stock certificate
22A news flash card, back
22B news flash card, front
24
26
28 die

SUMMARY

In accordance with the present invention, a board game based on stock market concepts comprises a game board; price-per-share cards denoting varying stock prices for each of four colors of stock; stock certificate cards, which occur in denominations of 100, 500, and 1000 shares for each of the four colors of stock; news flash cards, which contain instructions for random transactions in the form of an imaginary, fantastical, and/or humorous events that cause the price of a given stock to go up or down; a die for determining the number of spaces players move; and tokens resenting players as they move around the board.

DESCRIPTION OF INVENTION

A typical embodiment of the game board of the present invention is illustrated in FIG. 1. The game board 10 is the size typical of most standard game boards currently in existence. The game board consists of a single, noncontinuous path that begins at one top corner and ends at the opposite corner. The path consists of colored spaces in a repeated pattern of red, green, yellow, and blue. The path also contains five randomly occurring white spaces 12, which are blank, and six randomly occurring gray spaces containing the words News Flash 14. Purple spaces are positioned in such a way as to collectively form a bar going horizontally across the middle of the board with the words Market Update 16.

Figure 2:
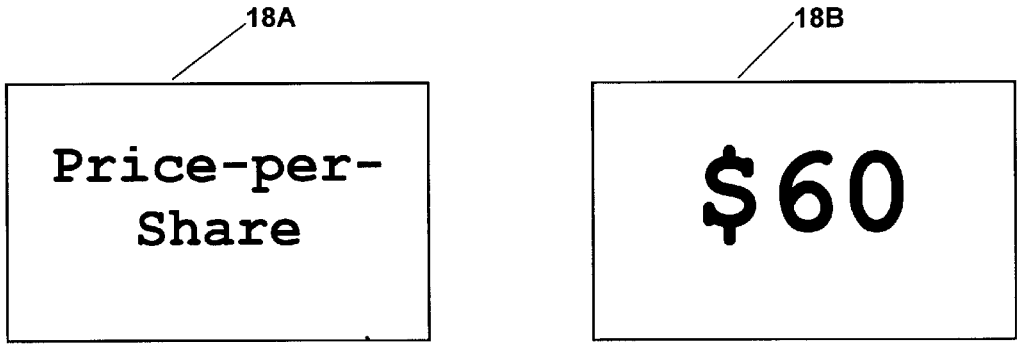
FIG. 2 shows a sample of price-per-share cards, which denote varying stock prices for each of four colors of stock: red, green, yellow, and blue.

A typical embodiment of price-per-share cards 18A–18B of the present invention is illustrated in FIG. 2. The price-per-share cards are grouped in four decks, corresponding to each of the four colors in the pattern on the path of the game board: red, green, yellow, and blue. The price-per-share cards span specific ranges in $1 increments for each color. Red price-per-share cards range from $60 to $100 per share for red stock, green price-per-share cards range from $40 to $70 per share for green stock, yellow price-per-share cards range from $20 to $40 per share for yellow stock, and blue price-per-share cards range from $10 to $20 per share for blue stock. Each price appears twice in each color deck.

Figure 3:
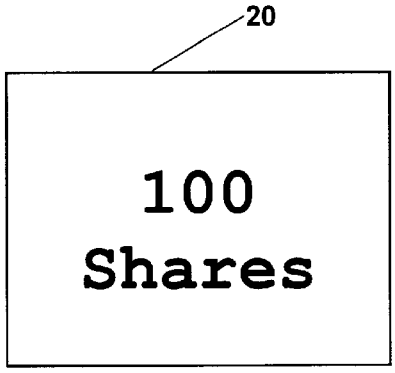
FIG. 3 shows a sample of stock certificate cards, which occur in denominations of 100, 500, and 1000 shares for each of the four colors of stock.

A typical embodiment of stock certificate cards 20 of the present invention is illustrated in FIG. 3. The stock certificate cards are grouped in four decks, corresponding to each of the four colors in the pattern on the path of the game board: red, green, yellow, and blue. Each deck is identical except for the color, and stock certificates occur in denominations of 100, 500, and 1000 shares.

Figure 4:
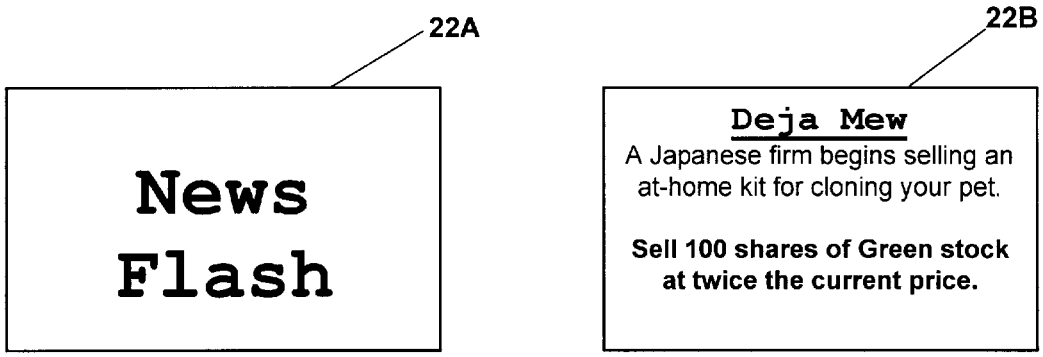

A typical embodiment of news flash cards 22A–22B of the present invention is illustrated in FIG. 4. The news flash cards express an imaginary, fantastical, and/or humorous event that causes the price of a specified stock to go up or down and instructs the player who has chosen the card to buy or sell the specified stock at the specified price.

Figure 5:
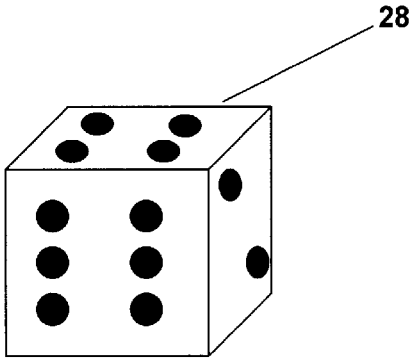
FIG. 5 shows a sample of the balance sheet used by players to record transactions track their balance.

A typical embodiment of the balance sheet 24 is illustrated in FIG. 5. Players use the balance sheet to record transactions. Players track their balance in the balance column 26 of the balance sheet.

A typical embodiment of a die 28 is illustrated in FIG. 6. Players use the die to designate a number of spaces they move their tokens along the game path.

OPERATION OF INVENTION

The manner of playing the board game based on stock market concepts uses all of the components illustrated in FIGS. 1–6.

The object of the game is for players to increase their worth by shrewdly buying and selling stock as they move around the board.

Players Set Up and Prepare for Play

Players set up the game board 10.

Players place the four decks of price-per-share cards 18A–18B—red, green, yellow, and blue—separately and face down near the board. Players turn over the top card for each color. This is the starting price-per-share for each color of stock.

Players place the deck of news flash cards 22A–22B face down near the board.

One player volunteers to be the broker and hand out stock certificates 20 when they are bought and take them in when they are sold.

Before Play Begins

As a group, players decide on the following issues before play begins:

Starting balance—All players begin with the same amount of money. They decide how much they want to begin with—$25,000 is a good starting point, for example—and all players enter that amount at the top of their balance sheets 24 in the balance column 26. This decision allows for the accommodation of players' skills and preferences. Younger players, for example can begin with smaller amounts of money. Experienced and ambitious players can begin with very large amounts if they wish.

Goal—Players choose a goal to reach. It may be to double the starting balance. It may be to reach any given amount that all players agree on.

Debt—Players decide whether they can go into debt to buy stock when they don't have enough money on their balance sheet. This decision allows for the accommodation of players' skills and preferences. Inexperienced or younger players may not want to allow debt, since this may require mathematical skills they have not acquired yet.

How to Move Around the Game Board

Players put their tokens on any white space 12 on the game board 10 to begin play.

When it is a player's turn, the player throws the die 28 and moves the number of spaces indicated. Players move their tokens from left to right around the board.

When players land on a white space 12, they may jump to any other white space on the board. Moving from one white space to another counts as moving one space. Then players continue moving until they have moved the number of spaces indicated on the die.

When players reach the white space 12 at the far right of the board, they move to any other white space on the board.

When players turn a corner, they may make some strategic counting choices to their advantage. A corner consists of three spaces: one horizontal space is adjacent to two vertical spaces. Players can count both of the vertical spaces, or they may count just one of them, depending on what color space they would like to land on.

What the Spaces Mean and What can be Done on Them

When players land on a red space, they may buy or sell red stock at the current price per share. Red stock prices range, in $1 increments, from $60 to $100 per share. Each price appears twice in the deck of red price-per-share cards.

When players land on a green space, they may buy or sell green stock at the current price per share. Green stock prices range, in $1 increments, from $40 to $70 per share. Each price appears twice in the deck of green price-per-share cards.

When players land on a yellow space, they may buy or sell yellow stock at the current price per share. Yellow stock prices range, in $1 increments, from $20 to $40 per share. Each price appears twice in the deck of yellow price-per-share cards.

When players land on a blue space, they may buy or sell blue stock at the current price per share. Blue stock prices range, in $1 increments, from $10 to $20 per share. Each price appears twice in the deck of blue price-per-share cards.

When players land on a news flash space 14, they pick a news flash card 22A–22B from the deck and follow the instructions.

When players land on a white space 12, they may move to any other white space on the board.

When any player lands on or passes over a purple space that makes up the market update bar, the stock prices are changed. Players turn over the top card of each color deck of price-per-share cards 18A–18B.

News Flash

When players land on a space marked news flash 14, they take a news flash card 22A—22B from the top of the deck.

Players read the instructions. They must follow the instructions if they can. For example, if the card says, "Buy 100 shares of stock for $5 per share less than the current price," and the player has enough money to do so, the player must buy the stock. If the card says, "Sell 100 shares of yellow stock at half the current price," the player must do so if the player owns 100 shares of yellow stock. If the player does not own any yellow stock, the player can't do anything. The player puts the news flash card on the bottom of the deck. Players cannot save a news flash card for future use.

How the Stock Prices Change

When any player lands on or passes over a purple space which makes up the purple market update bar 16, players turn over the top card of each color deck of price-per-share cards. This is the new current price-per-share for each color of stock. This price remains in effect until another player lands on or passes over the purple market update bar. The stock prices therefore change rapidly and unpredictably.

How to Buy and Sell Stock

Players put the agreed-upon beginning balance in the top space of the balance column 26 on their balance sheet 24. All players begin with the same balance.

Players can buy or sell a particular color of stock when they land on a space of the corresponding color on the game board 10.

Players can purchase shares of stock in quantities of 100, 500, or 1000 shares. When players purchase stock shares, they enter on their balance sheet the color of the stock they purchase, the number of shares they buy, the price per share, and the total cost. Then they subtract the total cost from their balance.

The broker gives players the appropriate number of stock certificates 20.

Players write down the price-per-share paid. This will help them to know when they can sell these shares to make a profit.

When players sell stock shares, they enter on their balance sheet 24 the color of the stock they sell, the number of shares they sell, the price per share, and the total profit. Then players add the total profit to their balance.

Players return the stock certificates they sell to the broker.

How the Game Ends

The game ends when one player achieves the goal that was agreed upon at the beginning of the game or when all players agree to end the game.

If players agree to end the game before anyone achieves the agreed-upon goal, a sell-off round is declared. The market is updated—the top price-per-share card 18A–18B for each color is turned over. This is the current price-per-share for each color stock. Players must sell all of their stock at the current prices. The player who has the highest ending balance on the balance sheet 24 wins.

Conclusion, Ramifications, and Scope of Invention

Accordingly, the reader will see that the board game based on stock market concepts is clean and simple in design and that it is easy to learn and easy to play.

Furthermore, the game has additional advantages in that:

it is easy and inexpensive to manufacture;

it reflects the power, excitement, and speed of today's stock market;

it incorporates some flexibility to accommodate players' skills and preferences;

it allows players to make strategic choices;

it improves on the weaknesses and shortcomings of the prior art.

Although the description above contains many specificities, these should not be construed as limiting the scope of the invention but as merely providing illustrations of some of the presently preferred embodiments of this invention. For example, the game board could consist of a different design, the path on the game board could consist of different colors; the instructions for play could vary, the price-per-share ranges could vary, and so forth.

Thus, the scope of the invention should be determined by the appended claims and their legal equivalents rather than by the examples given.

I claim:

1. A board game based on stock market concepts comprising:

a) a plurality of cards designating varying stock prices in a predetermined range of whole dollar amounts for each of four groups of stocks represented by the different colors, whereby the cards are randomly shuffled and one card from each group of stock is turned face up to designate the current stock prices, b) a plurality of stock certificate cards representing four generic groups of stocks represented by the colors red, green, yellow, and blue, c) a plurality of random transaction cards, whereby a player who draws a card from the randomly shuffled plurality reads the information contained on said card and performs the suggested transaction if possible, d) a game board having a single, noncontinuous path of variably-colored spaces, wherein said variebly-colored spaces have different meanings and applications to game play, including the ability of players going around corners on said path, to count or skip certain spaces for strategic positioning to benefit said player, further wherein said path includes six purple spaces positioned in such a way as to collectively form a bar going horizontally across the middle of said board and containing the words market update, whereby when any player lands on or passes over any said purple space anywhere on said path, a card designating an increment of whole dollar amounts is turned over for each color group of stock, changing the price per share of each group of stock, e) a plurality of tokens representing players as they move along said path, f) a random number generating means for designating a number of spaces players move said tokens along said path.

2. A board game based on stock market concepts as recited in claim 1, wherein said cards designating stock prices in a predetermined range of whole dollar amounts comprise four generic groups of stocks represented by the colors red, green, yellow, and blue.

3. A board game based on stock market concepts as recited in claim 2, wherein said cards designating stock prices in a predetermined range of whole dollar amounts span specific ranges for each color including red at $60 to $100 per share, green at $40 to $70 per share, yellow at $20 to $40 per share, and blue at $10 to $20 per share.

4. A board game based on stock market concepts as recited in claim 3, wherein said whole dollar amounts each occur twice in each color group, whereby when said plurality of cards is randomly shuffled, said stock prices change rapidly, unpredictably, and dramatically.

5. A board game based on stock market concepts as recited in claim 1, wherein said stock certificate cards are in denominations of 100, 500, and 1000 shares for each color of stock.

6. A board game based on stock market concepts as recited in claim 1, wherein said random transaction cards express imaginary fantastical, and/or humorous events and suggest a transaction only for the player who has drawn the card to perform.

7. A board game based on stock market concepts as recited in claim 1, wherein said single, noncontinuous path of varibly-colored spaces comprises a repeated pattern of red, green, yellow, and blue spaces corresponding to four color groups of stocks, whereby players may buy or sell the color stock corresponding to the color of the space they land on at the current market price if they wish.

8. A board game based on stock market concepts as recited in claim 7, wherein said path further includes five randomly-occurring white spaces, whereby players landing on said white spaces can move to any other white space on said path to strategically position themselves to land on a color space that is to their strategic advantage.

9. A board game based on stock market concepts as recited in claim 7, wherein said path further includes six randomly-occurring gray spaces with the words news flash, whereby players landing on said spaces draw a news flash card and follow the given instructions if they are able.

10. A board game based on stock market concepts as recited in claim 1, wherein said random number generating means is a die.

* * * * *